US007324122B2

(12) United States Patent
Tsai

(10) Patent No.: US 7,324,122 B2
(45) Date of Patent: Jan. 29, 2008

(54) DISPLAY SYSTEM AND METHOD FOR IMAGE OVERLAPPING

(75) Inventor: Chih Ming Tsai, Wugu Township, Taipei County (TW)

(73) Assignee: ICP Electronics Inc., Taipei Hsien (TW)

( * ) Notice: Subject to any disclaimer, the term of this patent is extended or adjusted under 35 U.S.C. 154(b) by 745 days.

(21) Appl. No.: 10/800,879

(22) Filed: Mar. 15, 2004

(65) Prior Publication Data

US 2005/0055356 A1 Mar. 10, 2005

(30) Foreign Application Priority Data

Sep. 9, 2003 (TW) ..... 92124855 A

(51) Int. Cl.
*G09G 5/10* (2006.01)

(52) U.S. Cl. ..... 345/690; 345/1.1; 345/1.3; 345/9

(58) Field of Classification Search ..... 345/690, 345/1.1, 1.3, 9
See application file for complete search history.

(56) References Cited

U.S. PATENT DOCUMENTS 5,694,560 A * 12/1997 Uya et al. ..... 715/781
6,611,241 B1 * 8/2003 Firester et al. ..... 345/1.3
6,965,453 B1 * 11/2005 Mori ..... 358/1.9

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A display system and method for image overlapping are described. The display system includes a detection module, a transmission interface, a switch output device and a control module. The detection module receives a first image and detects synchronous signals of the first image. The transmission interface is coupled to the detection module and receives a second image having position display information. The switch output device is coupled to the detection module to output the first image. The control module coupled to the detection module, the transmission interface and the switch output device, respectively, dominates the switch output device to output the second image according to the synchronous signals and the position display information such that the second image overlaps the first image.

17 Claims, 3 Drawing Sheets

DISPLAY SYSTEM AND METHOD FOR IMAGE OVERLAPPING

BACKGROUND OF THE INVENTION

1. Field of the Invention

The present invention relates to an image display system and method, and particularly to a system and method that overlaps and displays images using a control module and a switch output device.

2. Description of the Related Art

In conventional computer systems, an image overlapping function is provided therein. For example, a monitor always configures an OSD (On Screen Display) module for users to implement related monitor settings. Once triggered, the OSD menu of the setting interface is displayed and overlaps the original image. The above mechanism, however, is implemented by software, that is the CPU (Central Processing Unit) of the computer system or microprocessor of the monitor must perform complicated calculations to accomplish the function.

Typically, computer systems allocate the majority of their resources to handle other processes or control stand-alone devices. No additional capacity therefore exists for calculation of the image overlapping by using software processing. In addition, the KVM (Keyboard Video and Mouse) device of an image monitoring system merely input and display video signals on the monitor, and must switch the signals to display different images. The conventional art fails to enable the KVM device to display specific figures, characters, or images overlapping the originally displayed image.

SUMMARY OF THE INVENTION

It is therefore an object of the present invention to provide a system and method utilizing a hardware implementation to overlap displayed images.

It is another object of the present invention to provide a system and method that employs a control module to transmit a switch instruction to a switch output device, to overlap and display images.

To achieve the above objects, the present invention provides a display system and method for image overlapping. The display system includes a detection module, a transmission interface, a switch output device and a control module. The detection module receives a first image, and detects synchronous signals of the first image. The transmission interface is coupled to the detection module, and receives a second image having position display information. The switch output device is coupled to the detection module to output the first image. The control module is coupled to the detection module, the transmission interface, and the switch output device, respectively, and then controls the switch output device to output the second image according to the synchronous signals and the position display information such that the second image overlaps the first image.

The display method for image overlapping according to the present invention first receives a first image, and detects synchronous signals of the first image. Then, a second image having position display information is either received or transmitted. Thereafter, the control module transmits the switch control instruction to output the second image according to the synchronous signals of the first image when the position display information of the second image conforms to a display status of the first image. The switch output device receives the first image and the second image from the control module, and then determines to output the first image or the second image according to the switch control instruction.

The detection module further determines resolution information of the first image according to the synchronous signals, and transmits the resolution information to a remote host via the transmission interface, in which the remote host may transmit the second image conforming to the resolution information to the display system of the present invention.

Further, the second image is converted by the display system or the remote host to have the image format required by the display system.

BRIEF DESCRIPTION OF THE DRAWINGS

The aforementioned objects, features and advantages of the invention will become apparent by referring to the following detailed description of the preferred embodiment with reference to the accompanying drawings, wherein.

DETAILED DESCRIPTION OF THE INVENTION

Figure 1:
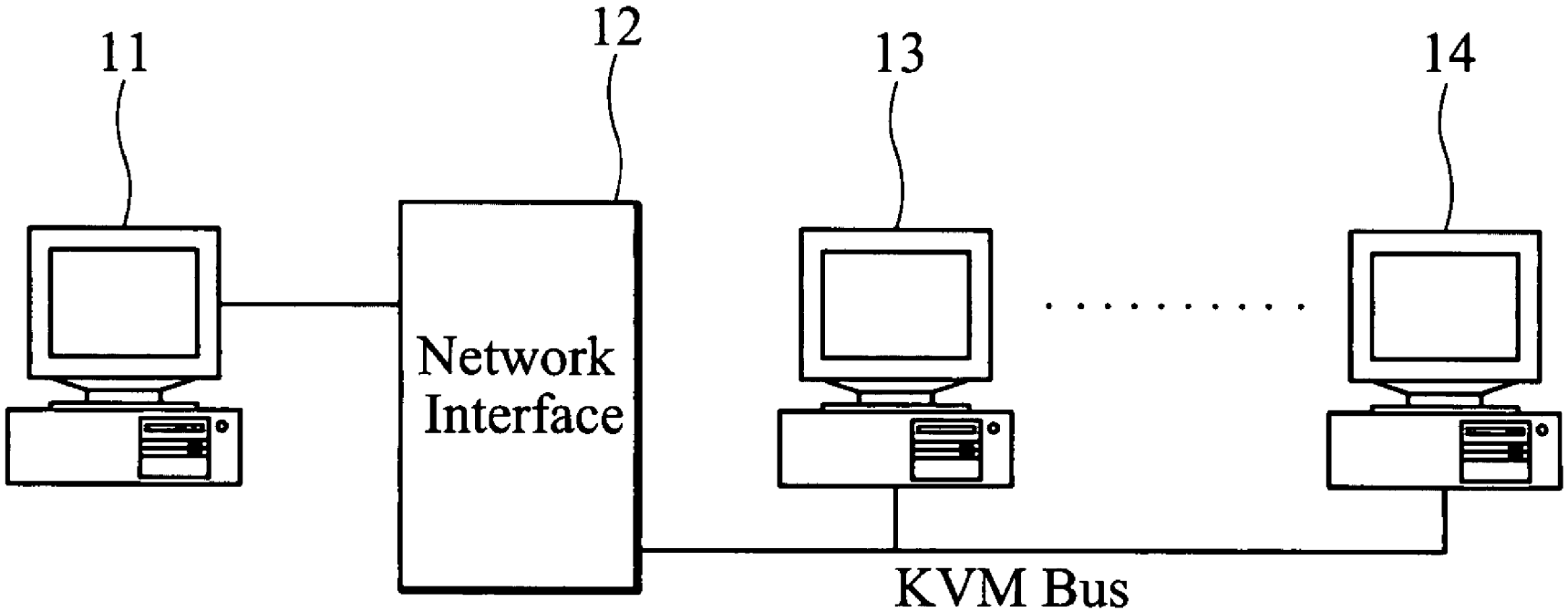
FIG. 1 is a schematic diagram illustrating a remote monitoring system.

FIG. 1 illustrates a remote monitoring system. The remote monitoring system manages clients via a KVM bus of a host 11 (server). Server switches can be used to monitor the computer systems (clients 13 and 14), and devices such as VGA (Video Graphics Array) of the computer systems in a LAN (Local Area Network) or WAN (Wide Area Network) through a network interface 12. It should be noted that the display system of the present invention can be applied to KVM systems, but not limited thereto.

Figure 2:
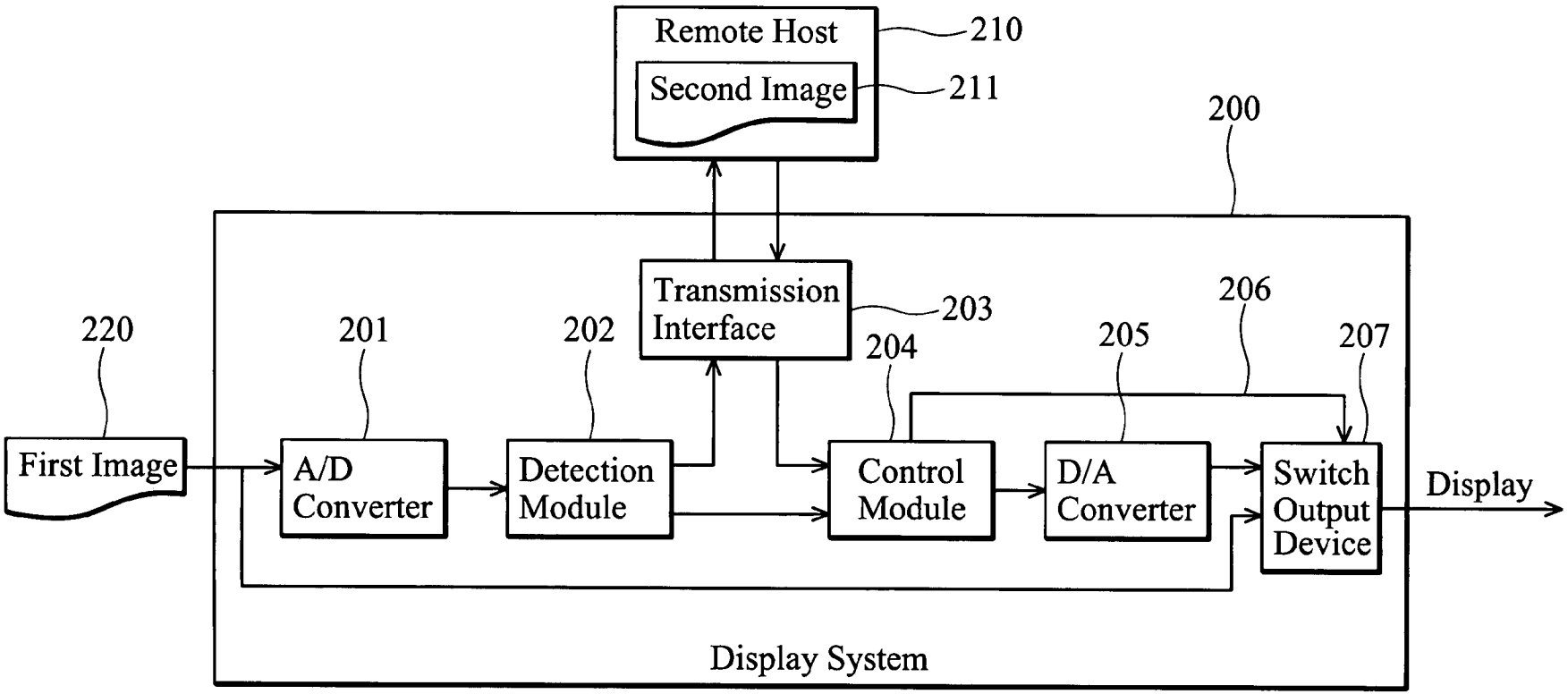
FIG. 2 is a schematic diagram illustrating the architecture of the display system for image overlapping according to an embodiment of the present invention.

FIG. 2 illustrates the architecture of the display system for image overlapping according to the embodiment of the present invention. The display system 200 includes an A/D (Analog/Digital) converter 201, a detection module 202, a transmission interface 203, a control module 204, a D/A (Digital/Analog) converter 205 and a switch output device 207.

The A/D converter 201 converts the format of an image from an analog signal format into a digital signal format, and the D/A converter 205 converts the format of an image from digital to analog signal format. It is understood that an image with analog signal format is discussed in the embodiment, however, if the image has digital signal format and the monitor performs a digital display, both the A/D converter 201 and the D/A converter 205 can be eliminated from the display system 200.

The detection module 202 receives a first converted image 220 transmitted from the A/D converter 201, and detects synchronous signals of the first image 220. It is understood that, image signals, such as R, G, B or composite video signals, and synchronous signals of the first image 220 are received and accompanied with the first image 220, in which the synchronous signals may include HSync (Horizontal Synchronous), VSync (Vertical Synchronous) and clock signals. Further, the detection module 202 determines the resolution information of the first image 220 according to the detected synchronous signals, and transmits the resolution information to a remote host 210 via the transmission interface 203. It should be noted that the transmission interface 203 is used for both the transmission of image and control signals between the remote host 210 and the display system 200, and it may be replaced by a microcontroller or a microprocessor.

The clock number in one Hsync pulse represents the pixel number of one line in a frame, and one Vsync pulse represents one transmitted frame, that is the number of Hsync pulses in one VSync pulse represents the number of rows in the frame. Therefore, resolution information can be obtained by analyzing the synchronous signals. In addition, if a preset resolution is default for both the remote host 210 and the display system 200, the step for resolution analysis of the detection module 202 can be omitted.

The remote host 210 may be a unit coupled via a bus interface in a computer system, or a computer host coupled via a communication network. The remote host 210 may convert a second image 211, conforming to resolution information, to an image format required by the display system 200 according to a mapping table (not shown in FIG. 2). The image format is a bitmap, JPEG and GIF format to overlap the first image 220. The second image 211 is then transmitted to the display system 200 by the remote host 210 via the transmission interface 203. The second image 211 also has position display information, such as the pixel resolution and coordinates of the second image 211.

It also should be noted that the format conversion of the second image 211 can be also performed by a conversion module (not shown in FIG. 2) of the display system 200, coupled to the transmission interface 203. The conversion module converts the second image 211 to have the image format required by the display system 200 according to the mapping table when the display system 200 receives the second image 211 via the transmission interface 203 without format conversion.

The control module 204 receives the synchronous signals of the first image 220 and the second image 211 from the detection module 202 and the transmission interface 203 respectively. A switch control instruction is then derived from the control module 204 according to the synchronous signals and the second image 211. The switch output device 207 is triggered by the switch control instruction of the control module 204 to output the second image 211 at a position conforming to the position display information of the second image 211. As a result, the second image 211 overlaps the first image 220.

Further, if the synchronous signals of the first image 220 and the first image 220 are simultaneously provided, the detection of the synchronous signals of the detection module 202 can be omitted. The control module 204 may receive the synchronous signals directly so as to improve the display switching delay between the first image 220 and the second image 211.

It is understood that the switch output device 207 may be an analog switch, a digital switch or a multiplexer. The switch output device 207 may receive, output and display the first image 220, without the need of first receiving the second image 211. Further, the D/A converter 205 may convert the format of the second image 211 from digital to analog before the control module 204 transmits it to the switch output device 207.

Next, an example of image overlapping is discussed. In the example, the second image 211 is a rectangle profile, and the position display information of the second image 211 includes a start coordinate (60, 30) and a size of pixel array 20×10. The traditional monitor displays an image from left to right and from the top to bottom, that is, the first pixel of the image is displayed at the position (0, 0). When it is necessary that the second image 211 overlaps the first image 220, the switch output device 207 first outputs pixels of the first image 220 corresponding to their positions from lines 1 to 29.

At line 30, the switch output device 207 outputs the pixels of the first image 220 corresponding to positions (0, 30) to (59, 30), and switches to output the pixels of the second image 211 corresponding to positions (60, 30) to (79, 30). At position (80, 30), the switch output device 207 switches back to output the pixels of the first image 220 corresponding to their positions until all pixels in the line 30 is completely displayed.

Similarly, at line 31, the switch output device 207 outputs pixels of the first image 220 which correspond to positions (0, 31) to (59, 31), and switches to output pixels of the second image 211 which correspond to positions (60, 31) to (79, 31). At position (80, 31), the switch output device 207 switches back to output pixels of the first image 220 which correspond to their positions until all pixels in the line 31 is completely displayed. The switch output device 207 continuously outputs pixels until all pixels in the line 39 is displayed, and then the second image 211 is completely displayed.

At line 40, the switch output device 207 then outputs pixels of the first image 220 corresponding to their positions until one complete frame is displayed.

It should be noted that the display area of the second image 211 can be determined according to the start coordinate and the pixel size of the second image 211 directly, or by calculating its boundary coordinates according to the start coordinate and the size of the second image 211. The boundary coordinates are then used to control the output of the switch output device 207. In addition, if the monitor has no restriction on display sequence, the switch output device 207 may directly display the second image 211 according to its position display information, and display image pixels of the first image 220 at the other positions of the frame on the monitor.

Figure 3:
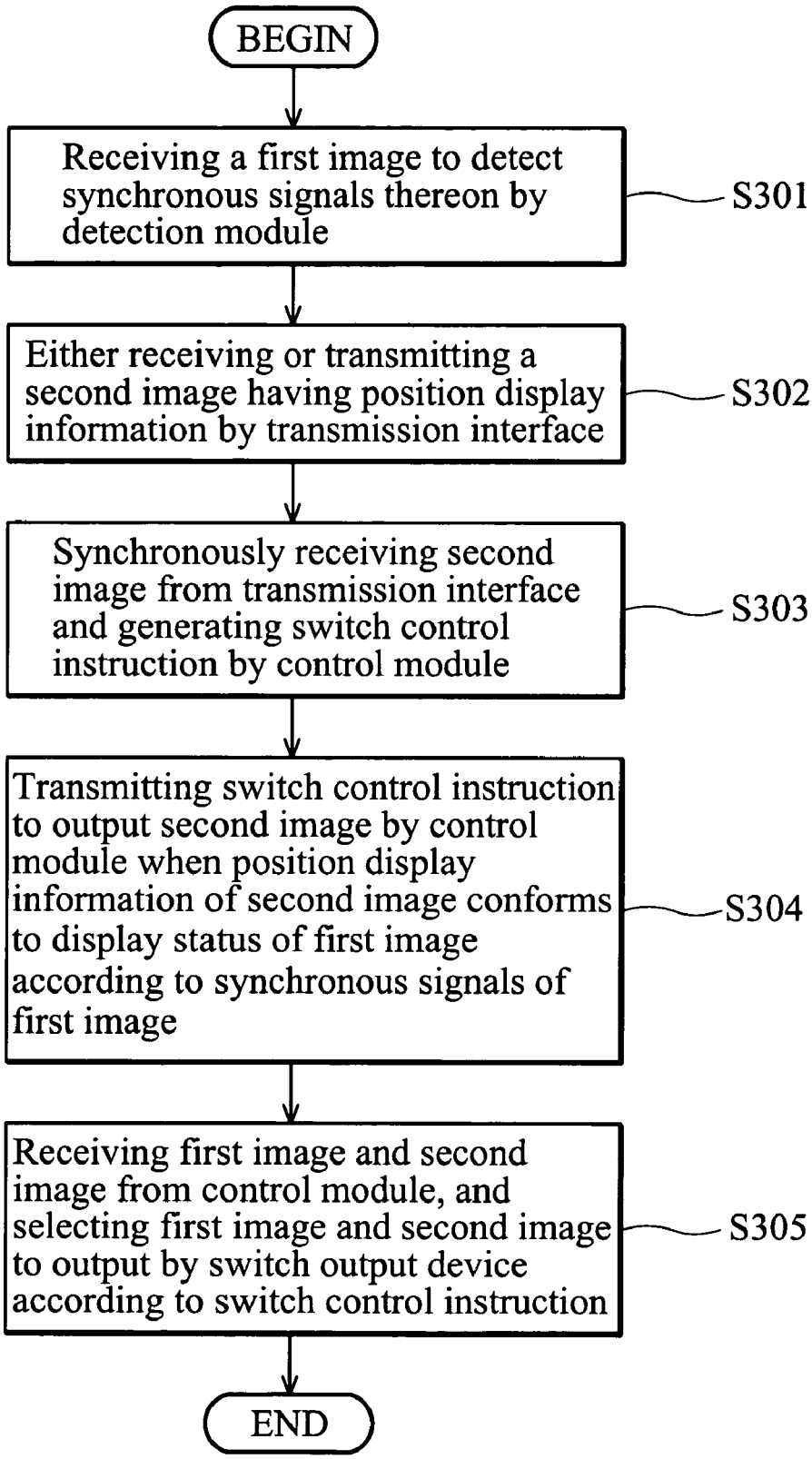
FIG. 3 is a flowchart showing the process of the display method for image overlapping according to an embodiment of the present invention.

FIG. 3 shows the process of the display method for image overlapping according to the embodiment of the present invention. In step S301, the detection module 202 of the display system 200 receives a first image 220, then detects, and transmits synchronous signals therein to the control module 204. Similarly, the A/D converter 201 may convert the format of the first image 220 from analog to digital, providing the first image 220 to the detection module 202. If the first image 220 is already in digital signal format, the conversion can be omitted.

Then, in step S302, the transmission interface 203 of the display system 200 receives a second image 211 from the remote host 210. The second image 211 having the position display information conforms to both the resolution information of the first image 220 and the image format of the display system 200. In addition, in step S303, the control module 204 receives the second image 211 synchronously, and generates a switch control instruction according to the synchronous signals of the first image 220 and the second image 211. Similarly, if the remote host 210 does not contain the resolution information of the first image 220, the detection module 202 determines the resolution information of the first image 220 according to the detected synchronous signals, and transmits the resolution information to the remote host 210. Further, the remote host 210 performs a conversion procedure in advance, such that the second image 211 has the image format required by the display system 200.

Thereafter, in step S304, the control module 204 transmits the switch control instruction to the switch output device 207. The control module 204 also outputs the second image 211 to the switch output device 207 when the position display information of the second image 211 conforms to the display status of the first image 220.

Finally, in step S305, the switch output device 207 receives the first image 220 and the second image 211 from the control module 204. The switch output device 207 selects the first image 220 or the second image 211 to output according to the switch control instruction such that the second image 211 overlaps the first image 220, and shows the overlapped image on the display device. Similarly, if the display device only receives analog signals, the D/A converter 205 converts the format of the second image 211 from digital to analog.

As a result, the display system and method for image overlapping according to the present invention can overlap and display the images using a hardware implementation without consuming any computer system resources.

Although the present invention has been described in its preferred embodiments, it is not intended to limit the invention to the precise embodiments disclosed herein. Those skilled in this technology can still make various alterations and modifications without departing from the scope and spirit of this invention. Therefore, the scope of the present invention shall be defined and protected by the following claims and their equivalents.

What is claimed is:

1. A display system for image overlapping, comprising:

a detection module to receive a first image, and detect synchronous signals therein;

a transmission interface coupled to the detection module to receive a second image having position display information;

a control module coupled to the detection module and the transmission interface to receive the synchronous signals and the second image, generate a switch control instruction, and transmit the switch control instruction for outputting the second image when the position display information of the second image conforms to a display status of the first image according to the synchronous signals of the first image; and a switch output device coupled to the control module to receive the first image and the second image, and select both the first image and the second image from the control module for outputting the first and second images according to the switch control instruction such that the second image overlaps the first image;

wherein the detection module further determines resolution information of the first image according to the synchronous signals, and transmits the resolution information via the transmission interface.

2. The display system of claim 1, wherein the transmission interface receives the second image conforming to the resolution information.

3. The display system of claim 1 further comprising a conversion module coupled to the transmission interface to convert the second image to have an image format conforming to that of the display system.

4. The display system of claim 3, wherein the image format is a bitmap format.

5. The display system of claim 1, wherein the synchronous signals of the first image comprises horizontal synchronous, vertical synchronous and clock signals.

6. The display system of claim 1, wherein the position display information comprises at least a coordinate and a pixel resolution size of the second image.

7. A display system for image overlapping, comprising:

a remote host to transmit a second image having position display information;

a detection module to receive a first image, and detect synchronous signals thereon;

a transmission interface coupled to the detection module and the remote host to receive the second image;

a control module coupled to the detection module and the transmission interface to receive both the synchronous signals and the second image, generate a switch control instruction, and transmit the switch control instruction for outputting the second image when the position display information of the second image conforms to a display status of the first image according to the synchronous signals of the first image; and a switch output device coupled to the control module to receive the first image and the second image, and select both the first image and the second image from the control module for outputting the first and second image according to the switch control instruction such that the second image overlaps the first image;

wherein the detection module further determines resolution information of the first image according to the synchronous signals, and transmits the resolution information to the remote host via the transmission interface.

8. The display system of claim 7, wherein the remote host transmits the second image conforming to the resolution information to the transmission interface.

9. The display system of claim 8, wherein the remote host further converts the second image into one having an image format of the first image.

10. The display system of claim 7, wherein the synchronous signals of the first image comprises horizontal synchronous, vertical synchronous and clock signals.

11. A display method for image overlapping, comprising the steps of:

receiving a first image to detect synchronous signals thereon by a detection module;

determining resolution information of the first image according to the synchronous signals;

transmitting the resolution information via a transmission interface;

either receiving or transmitting a second image having position display information by the transmission interface;

synchronously receiving the second image from the transmission interface and generating a switch control instruction by a control module;

transmitting the switch control instruction to output the second image by the control module when the position display information of the second image conforms to a display status of the first image according to the synchronous signals of the first image; and receiving the first image and the second image from the control module, and detecting to output the first image or the second image by a switch output device according to the switch control instruction.

12. The display method of claim 11 further comprising a step of receiving the second image conforming to the resolution information using the transmission interface.

13. The display method of claim 11 further comprising a step of converting the second image into one having an image format.

14. The display method of claim 13, wherein the image format is a bitmap format.

15. The display method of claim 11 wherein the synchronous signals of the first image comprises horizontal synchronous, vertical synchronous and clock signals.

16. The display method of claim 11, wherein the second image from the control module completely overlaps the first image.

17. The display method of claim 11, wherein the position display information comprises at least a coordinate and a pixel resolution of the second image.

* * * * *